US006186186B1

(12) United States Patent
Debaes et al.

(10) Patent No.: US 6,186,186 B1
(45) Date of Patent: Feb. 13, 2001

(54) METHOD AND WEAVING MACHINE FOR WEAVING A PILE FABRIC

(75) Inventors: Johnny Debaes, Moorslede; Bram Vanderjeugt, Ieper, both of (BE)

(73) Assignee: N.V. Michel Van de Wiele, Kortrijk/Marke (BE)

( * ) Notice: Under 35 U.S.C. 154(b), the term of this patent shall be extended for 0 days.

(21) Appl. No.: 09/318,812

(22) Filed: May 26, 1999

(30) Foreign Application Priority Data

May 28, 1998 (BE) ..... 09800412

(51) Int. Cl.[7] ..... D03D 39/16

(52) U.S. Cl. ..... 139/21; 139/37; 139/55.1

(58) Field of Search ..... 139/21, 37, 55.1, 139/391, 402; D03D 39/16, 39/00; D03L 13/00

(56) References Cited

U.S. PATENT DOCUMENTS 5,400,831 * 3/1995 Gheyson ..... 139/21
5,522,435 * 6/1996 DeRudder ..... 139/65

FOREIGN PATENT DOCUMENTS 455 673 7/1968 (CH) .
0 612 874 8/1994 (EP) .

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A face-to-face weaving machine with a weft insertion device (1), (2) is provided in order according to a top and a bottom insertion path to insert weft threads between warp threads (3–12). A lifting device (18, 19) works together with shed-forming devices (14), (15), (16), (17), of which first shed-forming device (14) is provided in order to bring warp threads (5), (6) above and between the insertion paths; second shed-forming device (15) is provided in order to bring warp threads (3), (4) between and below the insertion paths; third shed-forming device (16), (17) is provided in order to bring warp threads (7–12) above, between and below the insertion paths, such that the ratio (H/h) between, on the one hand the intermediate distance (H1), (H2) between two warp thread positions and on the other hand the lifting height (h) applied by the lifting device, is greater, preferably 1.5 times greater, for the third shed-forming device (16), (17) than for the first (14) and the second shed-forming device (15). A method is also provided for face-to-face weaving a pile fabric to be utilized on such a weaving machine. Because of this all shed-forming devices (16), (17) can work together with the same lifting device (18), (19), so that an ideal shed formation is possible by utilizing one single jacquard machine. Such a weaving machine is less expensive and less complex than the existing machines.

15 Claims, 1 Drawing Sheet

METHOD AND WEAVING MACHINE FOR WEAVING A PILE FABRIC

Figure 1:
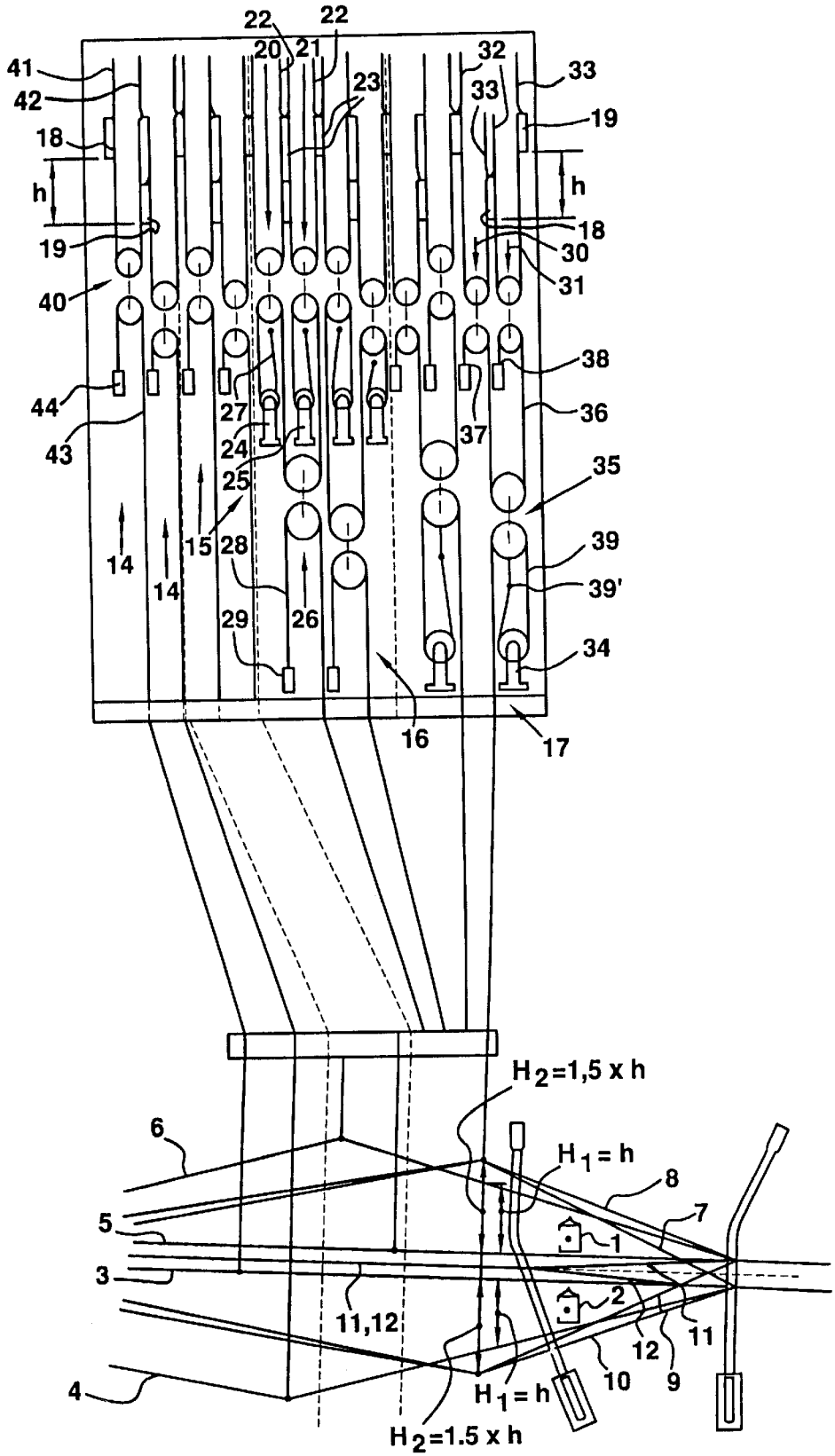

This invention relates to a weaving machine for manufacturing a face-to-face pile fabric, comprising a weft insertion device provided in order according to a top and a bottom insertion path to insert a respective weft thread between warp threads, and shed-forming means working together with a lifting device, of which first shed-forming means are provided in order to bring warp threads above and between the insertion paths, second shed-forming means are provided in order to bring warp threads between and below the insertion paths, and third shed-forming means are provided in order to bring warp threads above, between and below the insertion paths.

This type of face-to-face weaving machine enables pile fabrics to be woven according to a method whereby it is necessary to have at least three different operating (series of) shed-forming means.

Hence with these weaving machines among others a method can be utilized whereby in successive insertion cycles according to a top and a bottom insertion path a respective weft thread is inserted between warp threads while the positions of the warp threads are determined by shed-forming means working together with a lifting device, whereby first backing warp threads are brought alternately above and between the insertion paths so that a top backing fabric is woven, whereby second backing warp threads are brought alternately between and below the insertion paths so that a bottom backing fabric is woven, whereby pile warp threads are brought alternately above and below the insertion paths so that they form pile or are brought alternately above and between or between and below the insertion paths so that they are inwoven in the top or the bottom backing fabric, and whereby the pile-forming pile warp threads are cut through between the two backing fabrics. In that manner two pile fabrics are obtained.

This invention also relates to such a method, and the pile fabric manufactured according to such a method.

The above described weaving machine and method are known and are among others provided for face-to-face weaving of pile fabrics with areas in which pile-forming pile warp threads form a design, figure or pattern, and with other areas in which no pile is formed, and in which a pattern or effect (hereinafter called backing-warp-thread effect) is then made visible by the course of the warp threads of the backing fabric (hereinafter called backing warp threads).

A particular field of application of this weaving machine and method consists of weaving jacquard velvet with the characteristics mentioned in the preceding paragraph and with so-called weft effects by inserting (e.g. by means of a weft selection device) different colored weft threads. These weft effects contribute to a significant degree toward the typical wealth of colors of these types of fabrics. Such velvet cloths with areas without pile (chiseled) in which backing-warp-thread effects and weft effects appear are called "Italian Style Jacquard Velvet".

When weaving on a face-to-face weaving machine with double weft insertion according to the above described method the shed openings between the warp threads may not be too small in order not to hinder the weft insertion. On the other the hand the shed openings may not be too large either in order, through the greater liftings which the lifting device has to perform, not to restrict the weaving speed too much.

With a weaving machine with a weft insertion means movable according to a top and a bottom insertion path with the shed forming between the backing warp threads the following must also be taken into account: the backing warp threads are preferably brought to such a height between and below the insertion paths that they can guide the top, respectively the bottom, insertion means during its movement. If the shed opening is to great, this advantage is then lost.

For the pile warp threads the position between the insertion paths is lower than this position for the backing warp threads for the top backing fabric and higher than this position for the backing warp threads for the bottom backing fabric. From their position between the insertion paths the pile warp threads must therefore be brought upward over a greater height than the backing warp threads for the top backing fabric in order to extend above these insertion paths, and be brought downward over a greater height than the backing warp threads for the bottom backing fabric in order to extend below these insertion paths.

The ideal shed opening for the pile warp threads with this method is therefore larger than the ideal shed opening for the backing warp threads.

A first embodiment of the known weaving machine with the above described characteristics is a double-rapier weaving machine provided with three separate jacquard machines, namely a three-position open-shed jacquard machine for the pile warp threads, a first two-position open-shed jacquard machine for the backing warp threads of the top backing fabric, and a second two-position open-shed jacquard machine for the backing warp threads of the bottom backing fabric.

With the above described weaving machine the positions of the pile warp threads and the positions of the backing warp threads are determined by shed-forming means (e.g. tackle devices) of various jacquard machines. On each jacquard machine the level at which the shed is formed and the size of the shed opening can be separately adjusted, so that an ideal shed opening can be obtained both for the pile warp threads and for the backing warp threads. The adjustment of the shed opening occurs through an alteration in the lifting height of the knife devices of the jacquard machines.

A second embodiment is distinguished from the first because of the fact that only one two-position jacquard machine is provided for all backing warp threads. All shed-forming means of the two-position jacquard machine work together with the same knife device, so that the shed between the backing warp threads for the top backing fabric is the same size as the shed between the backing warp threads for the bottom backing fabric. The shed between the backing warp threads for the top backing fabric must be formed at a higher level than the shed between the backing warp threads for the bottom backing fabric. This difference in height is adjusted by a suitable levelling of the harness of the two-position jacquard machine. The shed-forming means which position the pile warp threads are however part of yet another jacquard machine. Hereon, by increasing the lifting height of the knife system, a larger shed opening can be set. An ideal shed opening can therefore be set both for the backing warp threads and for the pile warp threads.

The known weaving machines however have the disadvantage that on the jacquard machine for the pile warp threads and on the jacquard machine(s) for the backing warp threads a different lifting height of the knife system has to be set in order to obtain a different shed opening. Furthermore each jacquard machine requires a separate drive, so that three or two separate jacquard drives must therefore be provided. This makes the unit rather complex and expensive.

All shed-forming means of the known weaving machines have one and the same ratio between on the one hand the intermediate distance between two warp thread positions and on the other hand the lifting height applied by the lifting device. Were these shed-forming means provided in one and the same jacquard machine they would be driven by the same knife system and therefore work together with knives with one and the same lifting height. Because of this between the various positions for the pile warp threads and between the various positions for the backing warp threads the same intermediate distance would be obtained. The shed between the pile warp threads would therefore always be the same size as the shed between the warp threads.

Were a shed opening then set, which is ideal for the backing warp threads, and is therefore just large enough so that the backing warp threads would not obstruct the weft insertion, but is also nevertheless sufficiently small in order to enable the guiding of the weft insertion means and a sufficiently high weaving speed, then that same shed opening would be too small for the pile warp threads and the pile warp threads would obstruct the weft insertion.

Were a shed opening set which is just large enough so that the pile warp threads would not obstruct the weft insertion, then this shed opening for the backing warp threads would be too large in order to enable a guiding of the weft insertion means. Since the shed opening is adjusted by altering the lifting height of the lifting device the extension of this lifting height would furthermore also lead to a lesser weaving speed, and therefore result in a lower production of the weaving machine.

Because of these disadvantages it was until now not considered possible to obtain an efficiently operating weaving machine with a jacquard drive through adaptation of the known weaving machines.

A purpose of this invention is to provided a weaving machine of the above described type, of which all of shed-forming means can work together with a lifting device with the same lifting height, so that the lifting heights of various lifting devices need no longer be set differently in order to obtain an ideal shed formation, and so that the possibility exists for implementing the weaving machine with one lifting device and therefore also with one drive for the shed-forming means. The weaving machine can because of this indeed be made less expensive and complex than the known weaving machines, while an ideal shed formation for the backing warp threads and for the pile warp threads can nevertheless be obtained.

This purpose is achieved by according to this invention providing a weaving machine with the characteristics indicated in the first paragraph of this specification, but whereby the ratio between on the one hand the intermediate distance between two warp thread positions and on the other hand the lifting height applied by the lifting device, is greater for the third shed-forming means than for the first and the second shed-forming means.

With such a weaving machine an ideal shed opening between the backing warp threads can be obtained by means of one lifting device (e.g. a knife system) or several lifting devices with equal lifting height, while a larger shed opening is obtained for the pile warp threads which is sufficiently large in order not to obstruct the weft insertion. The various lifting devices with equal lifting height can possible be part of different jacquard machines disposed one next to another which are provided in order to operate according to this invention.

Because of the fact that the lifting to be implemented by the lifting device can remain restricted, and for example can be just the same size as the lifting height of the jacquard machine(s) for the backing warp threads of the known weaving machines, weaving can furthermore also be effected at the highest weaving speed.

This weaving machine according to the invention therefore combines a problem-free shed formation and weft insertion with a high weaving speed. Because of the fact that it can furthermore also work with one single driving means (since the possibility exists of working with one lifting device), it can also be less complex and therefore less expensive than the known weaving machines.

Another purpose of this invention is to provide a method for face-to-face weaving a pile fabric, which can be utilized on a face-to-face weaving machine with one or several lifting devices with one and the same lifting height, and is therefore particularly suitable for utilization on a weaving machine with one lifting device and one driving means for the shed-forming means, and nevertheless enables a problem-free shed formation and double weft insertion as well as a high weaving speed.

This purpose is achieved by utilizing a method with the characteristics indicated in the third paragraph of this specification, whereby the ratio between on the one hand the intermediate distance between two warp thread positions and on the other hand the lifting height applied by the lifting device, is greater for the third shed-forming means than for the first and the second shed-forming means.

The manner in which the predetermined objectives have been achieved with this method is clear from what has been explained with respect to the weaving machine according to this invention.

In a preferred embodiment of the weaving machine according to this invention the first, second and third shed-forming means work together with a lifting device which can be driven by one and the same driving means.

Because of this the weaving machine is less expensive and complex than the known weaving machines with two or three separate jacquard drives.

The aforesaid ratio for the third shed-forming means is preferably almost 1.5 times greater than this ratio for the first and the second shed-forming means.

Such a situation is ideal for guaranteeing an ideal shed formation between the pile warp threads and the backing warp threads. This is furthermore, as will appear from what follows, relatively easy to implement (by using tackle devices).

If the aforesaid ratio for the first and the second shed-forming means is furthermore almost equal to 1, operation can occur with a minimum lifting height of the lifting device, and therefore a maximum weaving speed.

In a preferred embodiment of the weaving machine according to this invention the first, second and third shed-forming means work together with a knife system with at least one pair of knives that can move upward and downward in opposite phase.

A very advantageous embodiment of the weaving machine according to this invention comprises a weft device with two weft insertion means, which are respectively movable according to the top and the bottom insertion path in order to insert a weft thread, while the first and/or the second shed-forming means are provided in order to bring warp threads into such a position between, respectively below, the insertion paths that they can guide the weft insertion means movable according to the upper insertion path. Such a method is also very much preferred.

The third shed-forming means can for example be three-position tackle devices of a jacquard machine, while the first and the second shed-forming means are two-position tackle devices of the same jacquard machine.

A third shed-forming means in a first preferred embodiment comprises:

a first and a second tackle element with at least one pulley, which can be moved upward and downward by respective lifting means, a first and a second reversing pulley disposed at a fixed height, a third tackle element with a first and a second pulley, and a first tackle cord that is connected to the first and the second tackle element and between the two tackle elements is passed successively over the first reversing pulley, a pulley of the first tackle element, a first pulley of the third tackle element, a pulley of the second tackle element, and the second reversing pulley, and a second tackle cord that is connected to the frame of the jacquard machine, and is passed from this connection over the second pulley of the third tackle element, and is provided past this second pulley in order to carry along one or several warp threads.

A third shed-forming means in a second preferred embodiment comprises:

a first and a second tackle element with at least one pulley, which can be moved upward and downward by respective lifting means, a reversing pulley disposed at a fixed height, a third tackle element with a first and a second pulley, a first tackle cord that is connected in two locations to the frame of the jacquard machine, and between these connections is passed successively over a pulley of the first tackle element, the first pulley of the third tackle element, and a pulley of the second tackle element, and a second tackle cord that is connected to the third tackle element, and from this connection is passed successively over the reversing pulley and the second pulley of the third tackle element, and is provided past this second pulley in order to carry along one or several warp threads.

A first and/or a second shed-forming means preferably comprise:

a tackle element with at least one pulley, which can be moved upward and downward by respective lifting means, and a tackle cord that is connected to the frame of the jacquard machine, and from this connection is passed over a pulley of the tackle element, and is provided past this pulley in order to carry along one or several warp threads.

Preferably the above described embodiments of the first, second and third shed-forming means are so implemented that each connection of a tackle cord to the frame of the jacquard machine is adjustable in height.

Because of this the levels of the warp thread positions to be set by the shed-forming means can be altered in a simple manner, which is among others very useful for setting the ideal level in relation to the insertion paths.

The weaving machine in a particularly preferred embodiment comprises a weft selection device, which is provided in order from a number a different weft threads in each case to select the weft threads to be inserted. Moreover the weft threads are selected in accordance with a pattern or effect to be formed in the pile fabrics. This weaving machine is because of this particularly suitable for among others weaving "Italian Style Jacquard Velvet".

This invention is further explained in the following more detailed specification of an embodiment of a weaving machine according to this invention and of a method to be utilized thereon. Nothing from this specification may be interpreted as being a restriction on the invention defined in the claims of this patent application.

In this specification reference is made to the FIGURE attached hereto, which schematically represents a number of tackle devices of a jacquard machine of a double-rapier weaving machine according to this invention, and indicates how these tackle devices determine the positions of the backing warp threads and the pile warp threads in relation to the weft insertion means of the weaving machine.

A possible embodiment of the weaving machine according to this invention is a face-to-face double-rapier weaving machine provided with one single jacquard machine. The weaving machine has a top and a bottom rapier device, of which respective rapier rods (1), (2) can move according to insertion paths situated one above the other in order to insert a respective weft thread in successive insertion cycles in a top and a bottom shed between backing warp threads (3), (4); (5), (6) and pile warp threads (7–12).

The weft thread inserted by the top rapier device is in each case inwoven by top backing warp threads (5), (6), which are brought alternately above and between the insertion paths of the rapier devices, while the weft thread inserted by the bottom rapier device is in each case inwoven by bottom backing warp threads (3), (4), which are brought alternately between and below these insertion paths. In that manner a top and a bottom backing fabric is woven.

The top backing warp threads (5), (6) are brought between the insertion paths at such a height that they are just below the insertion path of the top rapier rod (1) so that they can guide this rapier rod (1) during its movement. The bottom backing warp threads (3), (4) are positioned between the insertion paths at a lower level than the top backing warp threads (5), (6), and are brought below the insertion paths at such a height that they are just below the insertion path of the bottom rapier rod (2) so that they can guide this rapier rod (2) during its movement.

Meanwhile pile warp threads (7), (9) are brought alternately above and below the rapier insertion paths so that they form pile, other pile warp threads (8), (11) brought alternately above and between these insertion paths so that they are inwoven in the top backing fabric, and yet other pile warp threads (10), (12) brought alternately between and below these insertion paths so that they are inwoven in the bottom backing fabric. The pile warp threads are brought between the insertion paths at a level that is situated between the level at which the top (5), (6) and the bottom backing warp threads (3), (4) are brought between these insertion paths.

In order to bring the warp threads (3–12) in every insertion cycle to the desired height a jacquard machine (13) is provided. This jacquard machine is provided with tackle devices (14), (15), (16), (17) which work together with a knife system with knives (18), (19) that can move upward and downward in opposite phase. In the drawing attached hereto only the above mentioned parts of the jacquard machine (13) are schematically represented.

Two backing fabrics are thus obtained with pile-forming pile warp threads which are alternately interlaced in one and the other backing fabric, and with non-pile-forming pile warp threads, of which a part is inwoven in the top backing fabric and another part in the bottom backing fabric. The pile-forming pile warp threads are cut through between the two backing fabrics by means of a known cutting device, so that two pile fabrics are obtained.

For the top (5), (6) and the bottom backing warp threads (3), (4) different two-position tackle devices are provided.

These tackle devices are so adjusted that they can bring the top (5), (6) and the bottom backing warp threads (3), (4) to the correct heights in order to form a top respectively a bottom shed, and in order to guide the rapier rods (1), (2).

In order to obtain a problem-free shed formation with an optimum efficiency of the weaving machine the shed between the pile warp threads (7–12) must be larger than the top and the bottom shed between the backing warp threads (3), (4); (5), (6). In order to achieve this the backing warp threads (3), (4); (5), (6) are controlled by two-position tackle devices for which the intermediate position between two warp thread positions (H1) is equal to the lifting (h) of the knives working together therewith. (The ratio between this intermediate distance (H1) and this lifting (h) is therefore equal to 1), and the pile warp threads (7–12) are controlled by a three-position tackle device for which the intermediate distance (H2) between two warp thread positions is 1.5 times greater than the lifting of the knives (18), (19) working together therewith. (The aforesaid ratio is therefore 1.5). Since the lifting (h) of the knives of all tackle devices (14), (15), (16), (17) is equal, between the pile warp threads (7–12) a shed is formed which is 1.5 times larger than the shed formed between the backing warp threads (3), (4); (5), (6).

The two-position tackle devices (14), for the top backing warp threads (5), (6), the two-position tackle devices (15) for the bottom backing warp threads (3), (4), a first embodiment (16) of the three-position tackle devices and a second embodiment (17) of the three-position tackle devices, are represented in the FIGURE in different parts of the jacquard machine separated from each other by a dashed line.

The two-position tackle devices are provided with a tackle element (40) that is supported in the down-hanging loop of a cord that connects two hooks (41), (42). These hooks are carried along by a respective knife (18), (19) in an upward and downward movement in opposite phase. Each hook (41), (42) can also be selected in order to remain in a top position. In so doing the tackle element (40) can be brought into a top and a bottom position with an intermediate distance between the two positions, which is equal to half the lifting height (h) of the knives.

In the drawing it is clear that the free extremity of the tackle cord (43), which is connected via a harness cord to one or several warp threads (3), (4); (5), (6), can be brought into two positions with an intermediate distance (H1) which is the same as the lifting (h) of the knives (18), (19). One extremity of the tackle cord (43) is connected to a grating (44) adjustable in height, while the other extremity is connected via a harness cord to one or several warp threads (3–6).

The three-position tackle devices (16), (17) comprise a first (20); (30) and a second tackle element (21); (31) with two pulleys, which can be brought into a top and a bottom position by means of pairs of hooks (22), (23); (32), (33) working together with knives (18), (19), in the same manner as the tackle element (40) of the two-position tackle devices.

In a first embodiment a third shed-forming means (16) comprises two reversing pulleys (24), (25) disposed at a fixed height, a third tackle element (26) with two pulleys, a first tackle cord (27) that is connected to the first (20) and the second tackle element (21) and between the two tackle elements is passed successively over the first reversing pulley (24), a pulley of the first tackle element (20), a first pulley of the third tackle element (26), a pulley of the second tackle element (21), and the second reversing pulley (25), and a second tackle cord (28) that is connected to a grating adjustable in height of the jacquard machine, and from this connection (29) is passed over the second pulley of the third tackle element (26), and past this second pulley is connected to a harness cord in order to carry along one or several warp threads (7–12).

In a second embodiment the three-position tackle devices comprise one permanently attached reversing pulley (34) and a third tackle element (35) with two rotatable pulleys, while a first tackle cord (36) is connected by the extremities to gratings respectively adjustable in height and between this connection (37), (38) is passed successively over a pulley of the first tackle element (30), the first pulley of the third tackle element (35), and a pulley of the second tackle element (31), and a second tackle cord (39) that is connected to the third tackle element (35), and from this connection is passed successively over the reversing pulley (34) and the second pulley of the third tackle element (35), and past this second pulley is connected via a harness cord to one or several warp threads.

If both tackle elements (30), (31) are in their top position the pile warp threads (7–12) are brought into a "top" position, if one tackle element (30), (31) is in its top position and the other tackle element (31), (30) is in its bottom position, the pile warp threads (7–12) come into a "middle" position. If both tackle elements (30) (31) are in their bottom position the pile warp threads (7–12) come into a "bottom" position. The intermediate distance (H2) between the positions is 1.5 times the lifting (h) of the knives.

What is claimed is:

1. Weaving machine for manufacturing a face-to-face pile fabric, comprising a weft device (1), (2) provided in order according to a top and a bottom insertion path, to insert a respective weft thread between warp threads (3–12), and shed-forming means (14), (15), (16), (17) working together with a lifting device (18, 19), of which first shed-forming means (14) are provided in order to bring warp threads (5), (6) above and between the insertion paths, second shed-forming means (15) are provided in order to bring warp threads (3), (4) between and below the insertion paths, and third shed-forming means (16), (17) are provided in order to bring warp threads (7–12) above, between and below the insertion paths, characterized in that the ratio (H/h) between on the one hand the intermediate distance (H1), (H2) between two warp thread positions and on the other hand the lifting height (h) applied by the lifting device, is greater for the third shed-forming means (16), (17) than for the first (14) and the second shed-forming means (15).

2. Weaving machine, according to claim 1 characterized in that the first (14), second (15) and third shed-forming means (16), (17) work together with a lifting device (18, 19) which can be driven by one and the same driving means.

3. Weaving machine, according to claim 1 or 2 characterized in that the aforesaid ratio (H2/h) for the third shed-forming means (16), (17) is almost 1.5 times greater than this ratio (H1/h) for the first (14) and the second shed-forming means (15).

4. Weaving machine, according to any of the preceding claims characterized in that the aforesaid ratio (H1/h) for the first (14) and the second shed-forming means (15) is almost 1.5.

5. Weaving machine according to any of the preceding claims characterized in that the first (14), second (15) and third shed-forming means (16), (17) work together with a knife system with at least one pair of knives (18), (19) that can move upward and downward in opposite phase.

6. Weaving machine, according to any of the preceding claims characterized in that the weft device comprises two weft insertion means (1), (2) which are respectively movable according to the top and the bottom insertion path in order to insert a weft thread, and that the first (14) and/or the second shed-forming means (15) are provided in order to bring warp threads (3), (4); (5), (6) into such a position between, respectively below, the insertion paths that they can guide the weft insertion means (1), (2) movable according to the upper insertion path.

7. Weaving machine, according to any of the preceding claims characterized in that the third shed-forming means are three-position tackle devices (16), (17) of a jacquard machine, and that the first and the second shed-forming means are two-position tackle devices (14), (15) of the same jacquard machine.

8. Weaving machine, according to any of the preceding claims, characterized in that the third shed-forming means (16) comprises:

a first (20) and a second tackle element (21) with at least one pulley, which can be moved upward and downward by respective lifting means (22, 23), a first (24) and a second reversing pulley (25) disposed at a fixed height, a third tackle element (26) with a first and a second pulley, and a first tackle cord (27) that is connected to the first (20) and the second tackle element (21) and between the two tackle elements is passed successively over the first reversing pulley (24), a pulley of the first tackle element (20), a first pulley of the third tackle element (26), a pulley of the second tackle element (21), and the second reversing pulley (25), and a second tackle cord (28) that is connected to the frame of the jacquard machine, and is passed from this connection (29) over the second pulley of the third tackle element (26), and is provided past this second pulley in order to carry along one or several warp threads (7–12).

9. Weaving machine, according to any of the claims 1 through 7, characterized in that a third shed-forming means (17) comprises:

a first (30) and a second tackle element (31) with at least one pulley, which can be moved upward and downward by respective lifting means (32, 33), a reversing pulley (34) disposed at a fixed height, a third tackle element (35) with a first and a second pulley, a first tackle cord (36) that is connected in two locations to the frame of the jacquard machine, and between these connections (37), (38) is passed successively over a pulley of the first tackle element (30), the first pulley of the third tackle element (35), and a pulley of the second tackle element (31), and a second tackle cord (39) that is connected to the third tackle element (35), and from this connection (39') is passed successively over the reversing pulley (34) and the second pulley of the third tackle element (35), and is provided past this second pulley in order to carry along one or several warp threads.

10. Weaving machine, according to any of the preceding claims, characterized in that a first (14) and/or a second shed-forming means (15) comprise:

a tackle element (40) with at least one pulley, which can be moved upward and downward by respective lifting means (41), (42), and a tackle cord (43) that is connected to the frame of the jacquard machine, and from this connection (44) is passed over a pulley of the tackle element (40), and is provided past this pulley in order to carry along one or several warp threads.

11. Weaving machine, according to claim 8 or 9 or 10 characterized in that each connection (29); (37), (38); (44) of a tackle cord (28); (36); (43) to the weaving machine is adjustable in height.

12. Weaving machine, according to any of the preceding claims characterized in that the weaving machine comprises a weft selection device, which is provided in order from a number a different weft threads in each case to select the weft threads to be inserted.

13. Method for weaving a pile fabric on a face-to-face weaving machine, whereby in successive insertion cycles according to a top and a bottom insertion path a respective weft thread is inserted between warp threads (3–12), while the positions of the warp threads (3–12) are determined by shed-forming means (14), (15), (16), (17) working together with a lifting device (18, 19), whereby first backing warp threads (5), (6) are brought alternately above and between the insertion paths so that a top backing fabric is woven, whereby second backing warp threads (3), (4) are brought alternately between and below the insertion paths so that a bottom backing fabric is woven, whereby pile warp threads (712) are brought alternately above and below the insertion paths so that they form pile or are brought alternately above and between or between and below the insertion paths so that they are inwoven in the top or the bottom backing fabric, and whereby the pile-forming pile warp threads are cut through between the two backing fabrics characterized in that the ratio between on the one hand the intermediate distance (H1), (H2) between two warp thread positions and on the other hand the lifting height (h) applied by the lifting device (18, 19), is greater for the pile warp threads (7–12) than for the backing warp threads (3), (4); (5), (6).

14. Method for weaving a pile fabric according to claim 13 characterized in that the weft threads are inserted by a weft insertion means (1), (2) movable according to a top and a bottom insertion path and that the first (5), (6), and/or the second backing warp threads (3), (4) are brought into such a position between, respectively below, the insertion paths that they can guide the weft insertion means (1), (2) movable according to the upper insertion path.

15. Method according to claim 14 characterized in that different colored weft threads are inserted.

* * * * *